US006489089B1

(12) United States Patent
Brown et al.

(10) Patent No.: US 6,489,089 B1
(45) Date of Patent: Dec. 3, 2002

(54) BLEACH/FIX SOLUTION FOR SINGLE-USE SILVER REMOVAL IN COLOR NEGATIVE FILMS

(75) Inventors: Eric R. Brown, Webster, NY (US); John R. Fyson, London (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/705,404

(22) Filed: Nov. 3, 2000

(51) Int. Cl.[7] ..... G03C 7/42
(52) U.S. Cl. ..... 430/393
(58) Field of Search ..... 430/393

(56) References Cited

U.S. PATENT DOCUMENTS 3,615,508 A * 10/1971 Stephen et al. ..... 430/460
3,867,419 A * 2/1975 Iwano et al. ..... 430/460
4,753,868 A * 6/1988 Goda et al. ..... 430/460
6,322,261 B1 11/2001 Kuzyk ..... 396/625

FOREIGN PATENT DOCUMENTS

EP 0 271 061 3/1995
EP 0 901 041 A2 3/1999

* cited by examiner

*Primary Examiner*—Hoa Van Le
(74) *Attorney, Agent, or Firm*—Sarah Meeks Roberts

(57) ABSTRACT

A method of bleaching and fixing a developed silver halide color negative element comprising mixing a bleaching solution containing an oxidizing agent with a fixing solution containing a silver ion solubilizing agent to form a bleach-fixing solution; shortly after or simultaneously with said mixing, bleach/fixing the silver halide element by contacting it with the bleach/fixing solution; and discarding the bleach/fixing solution after one use; wherein the bleach/fixing step is performed at an elevated temperature; and wherein the silver halide color negative element comprises a silver bromoiodide emulsion with an average iodide content of more than 1 mol % iodide.

6 Claims, No Drawings

BLEACH/FIX SOLUTION FOR SINGLE-USE SILVER REMOVAL IN COLOR NEGATIVE FILMS

FIELD OF THE INVENTION

This invention relates to the processing of color silver halide photographic materials. It more specifically relates to a method of bleach/fixing color silver bromoiodide photographic materials.

BACKGROUND OF THE INVENTION

During processing of silver halide color photographic elements, the developed silver is oxidized to silver(I) by a bleaching agent, and the silver(I) is concurrently or subsequently dissolved by a fixing agent and removed from the element. If the silver is bleached and fixed concurrently, the process is referred to as a bleach/fixing process. Bleach/fixing of silver halide photographic elements containing silver chloride or silver bromochloride emulsions is well known and relatively rapid and complete silver oxidation in the presence of those kinds of emulsions can be accomplished. Bleaching agents that are commonly used in these bleach/fixers are complexes of high valent metal ions such as iron(III) with aminopolycarboxylic acid ligands, for example the ammonium salts of complexes of Fe(III) with ethylenediaminetetraacetic acid (EDTA), N-methyliminodiacetic acid (MIDA), diethylenetriaminepentaacetic acid (DTPA), and ethylenediaminedisuccinic acid (EDDS). Fixing agents that are commonly employed are ammonium or sodium thiosulfate salts, sometimes in combination with thiocyanate salts such as ammonium or sodium thiocyanate.

There continues to be interest in rapid photographic processing of photographic elements, including rapid bleaching or bleach/fixing. However, when silver halide color negative photographic elements containing predominantly silver bromide or silver iodobromide emulsions (such as color negative camera films) are bleached and fixed, bleaching and fixing can be slow and is often incomplete, particularly in a bleach/fixing process. In particular, iodide in the silver halide emulsions can retard bleaching and fixing. The residual silver can lead to variability in the photographic response and in the quality of the photographic image due to density variations from the residual silver. To help overcome this bleaching difficulty several alternative approaches have been tried. Silver halide emulsions with low iodide content (less than 2 mol %, preferably less than 1 mol %, more preferably less than 0.5 mol %) may be used, as described in EP 0 271 061 B1 (Ikenoue et al). Unfortunately such emulsions can lack the desired sensitivity to light that is necessary for a practical camera film element. Bleaching accelerators such as organic thiols or amines, silver salts of organic thiols, or compounds which release organic thiols, have been incorporated into the film elements, the bleaching solutions, or processing solutions used before the bleaching solution, as described in U.S. Pat. No. 3,893,858 (Wabnitz); U.S. Pat. No. 4,552,834 (Lau et al); U.S. Pat. Nos. 4,865,956; 4,923,784 (Harder et al); GB 1,138,842; Swiss Pat. 336,257; and EP 0 329 052 A2 (Kuse et al). However, these compounds often cause instability of the bleaching solution, or lose their effectiveness over time, and often bleaching is still incomplete despite the use of these accelerators. Coupler compounds that release bleach-accelerating compounds during image development (so-called bleach accelerator-releasing couplers, or BARCs) have been dispersed and incorporated into color negative film elements as described in U.S. Pat. No. 5,135,839 (Szajewski); U.S. Pat. No. 5,300,406 (Begley et al); U.S. Pat. No. 5,318,879 (Begley et al); U.S. Pat. No. 5,358,828 (Begley et al); U.S. Pat. No. 5,840,470 (Bohan et al); and EP 0 193 389 B2 (Hall et al)).

These compounds can improve bleaching by bleaching agents such as the ammonium, potassium, or sodium salts of Fe(III)EDTA, Fe(III)EDDS, Fe(III)(MIDA)2, Fe(III)(DTPA), or relatively dilute Fe(III)PDTA (a complex of Fe(III) with 1,3-propanediaminetetraacetic acid) that have relatively weak bleaching power, especially bleaching solutions of these bleaching agents that have been weakened during continued processing by the carrying-in of preceding color developer solution. Despite the use of these BARCs, which significantly improve bleaching rates, bleaching is still often too slow or incomplete for a rapid bleaching process. Stronger bleaching agents can be used, such as $FeCl_3$, potassium ferricyanide, relatively concentrated Fe(III)PDTA, hydrogen peroxide, periodate, or various catalyzed persulfate bleaches. But these bleaching agents, while effective, often require additional processing solutions (e.g. stop baths, accelerator baths) that are inconvenient for rapid, efficient processing. Furthermore, these bleaching agents are not compatible with thiosulfate fixing solutions and it has not been possible to prepare stable bleach/fixing solutions using these bleaching agents with the commonly used thiosulfate fixing agent.

There remains a need for a rapid, complete, non-staining silver removal process for silver halide color negative elements that have silver iodobromide emulsions with average iodide content of more than 1 mol % and good light sensitivity. There also remains a need for rapid processes that result in less densitometry variability, and that provide the rapid attainment of a stable density image.

SUMMARY OF THE INVENTION

This invention provides a method of bleaching and fixing a developed silver halide color negative element comprising mixing a bleaching solution containing an oxidizing agent with a fixing solution containing a silver ion solubilizing agent to form a bleach/fixing solution;

shortly after or simultaneously with said mixing, bleach/fixing the silver halide element by contacting it with the bleach/fixing solution; and discarding the bleach/fixing solution after one use;

wherein the bleach/fixing step is performed at an elevated temperature; and wherein the silver halide color negative element comprises a silver bromoiodide emulsion with an average iodide content of more than 1 mol % iodide.

This method allows the separate bleaching and fixing processing steps for silver bromoiodide color negative elements to be combined into one bleach/fixing step. With this invention strong oxidizing agents such as high concentrations of Fe(III)PDTA or $Fe(III)(MIDA)_2$ can be used in combination with silver ion solubilizing agents, (particularly thiosulfate), a combination which is not stable when stored in a single solution with bleach/fixing properties. This method makes it possible to remove silver from silver bromoiodide emulsions without the need for accelerators added to either the silver halide photographic element or to the bleach/fixing solution, although they may be added if desired. With this method high speed silver halide color negative elements can be bleached and fixed in 30 to 90 seconds in a single solution with complete removal of the incorporated silver components.

Additionally the process is efficient and cost effective. No seasoning of the process solution occurs from one silver halide color negative element to degrade the silver removal rate of subsequent elements. Additionally only the minimum amount of solution required to process the film element is used in the process. Since small volumes are used, the temperature of the process can be raised rapidly with a minimum amount of energy required and need only be maintained at the high temperature for the short time of the process. The waste solutions may be easily collected for treatment to remove the silver ion by conventional means such as electrolysis.

DETAILED DESCRIPTION OF THE INVENTION

In this invention a bleaching solution containing an oxidizing agent and a fixing solution containing a silver ion solubilizing agent are mixed to form a bleach/fixing solution. Shortly after or simultaneously with said mixing, the developed silver halide element is bleach/fixed by contacting it with the bleach/fixing solution. The bleaching solution and the fixing solution may be mixed by any means which will accomplish the goal of combining the two solutions and then making them available for contact with the silver halide element. It is anticipated that the solutions will be kept in separate reservoirs until they are combined. They may be pre-diluted to working strength solutions and then combined, or they may be in a concentrated form and combined simultaneously with the addition of water. Each solution may be in one part or multi-parts prior to combination to form the bleach/fixing solution. Preferably, each will be kept as one part at working strength and combined prior to use.

They may be combined in the processing station where they will come in contact with the photographic element or they may be combined in a channel leading to the processing station. The processing station may be any area within a processing apparatus wherein a photographic element can come in contact with a processing solution. Nonlimiting examples include tanks, chambers, channels and drums. The station may be dedicated to one type of processing solution or it may be utilized for one or more different types of processing solutions. The fixing solution and the bleaching solution may be combined in any manner known to those skilled in the art such as by mixing, agitation, spraying or any other means. The phrase "shortly after mixing" describing when the photographic element is put in contact with the bleach/fixing solution means within one hour of mixing. Preferably it means within 10 minutes of mixing, more preferably within one minute of mixing and most preferably within 10 seconds of mixing. The photographic material may also be placed in contact with the bleach/fixing solution simultaneously with the mixing of the fixing solution and the bleaching solution.

Bleach/fixing the silver halide element by contacting it with the bleach/fixing solution may also be done by any practical means, many of which are known to those skilled in the art. For example, the photographic material may be dipped in the bleach/fix solution, sprayed with the solution, transported on a belt through the solution or wetted by contact with a drum rotated through the solution. In one embodiment a method of processing may be utilized which comprises the steps of loading the photographic material into a chamber adapted to hold the material therein, introducing a metered amount of solution into the chamber, rotating the chamber and continuously sweeping the surface of the material as the chamber rotates to thereby form a wave in the solution through which the material passes, the whole volume of solution for a given stage being spread over the whole material area in a repetitive manner to enable uniform processing. The bleach/fixing process is generally performed in 20 to 120 seconds, and more preferably in 30 to 90 seconds.

The invention is most useful when bleach/fixing is done at an elevated temperature to achieve more rapid processing. At such elevated temperatures the bleach/fixing solution is very unstable Preferably the photographic element is bleach/fixed at greater than 45° C. A useful range, however, is 30° C. to 65° C., with 45° C. to 65° C. being more preferred and 45° C. to 55° C. being most preferred. The fixing and or bleaching solutions may be heated prior to mixing or during mixing or the bleach/fix solution may be heated after mixing. Preferably the bleach/fix solution is heated after mixing and some amount of time must be allowed for this process.

The bleach/fixing solution is discarded after one use, which generally means after one roll of film has been processed. As nonlimiting examples, one roll of film can be a 15 exposure roll of APS film, a 40 exposure roll of APS film, a 24 exposure roll of 35 mm film or a 36 exposure roll of 35 mm film.

Photographic bleaching compositions useful in this invention generally include one or more persulfate, peracid (such as periodates or percarbonates), peroxides (such as hydrogen peroxide) or high-valent metal ion bleaching agents, such as iron(III) complexes with simple anions (such as nitrate, sulfate, and acetate), or with carboxylic acid or phosphonic acid ligands. Particularly useful bleaching agents include iron complexes of one or more aminocarboxylic acids, aminopolycarboxylic acids, polyaminocarboxylic acids or polyaminopolycarboxylic acids, or salts thereof. Particularly useful chelating ligands include conventional polyaminopolycarboxylic acids including ethylenediaminetetraacetic acid and others described in *Research Disclosure* 38957, noted below, U.S. Pat. No. 5,582,958 (Buchanan et al) and U.S. Pat. No. 5,753,423 (Buongiome et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al), all of which are incorporated herein by reference in relation to their description of bleaching agents.

These and many other such complexing ligands known in the art including those described in U.S. Pat. No. 4,839,262 (Schwartz), U.S. Pat. No. 4,921,779 (Cullinan et al), U.S. Pat. Nos. 5,037,725, 5,061,608 (Foster et al), U.S. Pat. No. 5,334,491 (Foster et al), U.S. Pat. No. 5,523,195 (Darmon et al), U.S. Pat. No. 5,582,958 (Buchanan et al), U.S. Pat. Nos. 5,552,264, 5,652,087 (Craver et al), U.S. Pat. No. 5,928,844 (Feeney et al) U.S. Pat. No. 5,652,085 (Wilson et al), U.S. Pat. No. 5,693,456 (Foster et al), U.S. Pat. No. 5,834,170 (Craver et al), and U.S. Pat. No. 5,585,226 (Strickland et al), all incorporated herein by reference for their teaching of bleaching compositions. The total amount of bleaching agent(s) in the composition is generally at least 0.0001 mol/l, and preferably at least 0.05 mol/l. These amounts would apply to bleach/fixing compositions also.

Particularly useful oxidizing agents are iron complexes of one or more of ethylenediaminetetraacetic acid (EDTA), ethylenediaminedisuccinic acid (EDDS, particularly the S,S-isomer), methyliminodiacetic acid (MIDA) or other iminodiacetic acids, beta-alaninediacetic acid (ADA), ethylenediaminemonosuccinic acid (EDMS), 1,3-propylenediaminetetraacetic acid (PDTA), nitrilotriacetic acid (NTA), and 2,6-pyridinedicarboxylic acid (PDCA). For processing color negative materials a ferric complex of PDTA is preferred. Multiple bleaching agents can be present if desired.

Most useful are iron complexes having a redox potential greater than +150 mV vs Normal Hydrogen Electrode (NHE) at the pH of the bleach/fixing solution. The method used to determine the redox potential of the bleaching agent applies to a "ferrous-ferric-chelating agent" system and is a potentiometric measurement as described by J. Bond and T. I. Jones in 'Transactions of the Faraday Society', Volume 55, pp1310–1318, published in 1959, and incorporated herein by reference. For example, by their method, ferrous-ferric-EDTA has a redox potential of +118 mV vs NHE at pH 6 and ferrous-ferric-PDTA has a redox potential of +250 mV vs NHE at pH 5.

Other components of the bleaching solution include pH buffers, halides, corrosion inhibiting agents, and metal ion sequestering agents. These and other components and conventional amounts are described in the references in the preceding paragraph. Bleaching accelerators such as organic thiols or amines, silver salts of organic thiols, or compounds which release organic thiols, may be utilized although they are not necessary. The pH of the bleaching composition is generally from about 3 to about 6.5.

Useful fixing agents or silver ion solubilizing agents for photographic fixing compositions are well known. Examples of photographic fixing agents include, but are not limited to, thiosulfates (for example sodium thiosulfate, potassium thiosulfate and ammonium thiosulfate), thiocyanates (for example sodium thiocyanate, potassium thiocyanate and ammonium thiocyanate), thioethers (such as ethylenebisthioglycolic acid and 3,6-dithia-1,8-octanediol), imides and thiourea. Thiosulfates and thiocyanates are preferred, and thiosulfates are more preferred. Ammonium thiosulfate is most preferred. The general amount of total fixing agents in the fixing composition of this invention is at least 0.001 mol/L, and preferably at least 0.1 mol/L. These amounts would apply to bleach/fixing compositions also.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al), incorporated herein for the teaching of fixing compositions.

The fixing compositions use in this invention generally contain one or more monovalent or divalent cations supplied by various salts used for various purposes (for example, salts of fixing agents). It is preferred that the cations be predominantly ammonium cations, that is at least 50% of the total cations are ammonium ions. Such fixing compositions are generally known as "high ammonium" fixing compositions.

The fixing compositions used in this invention can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art.

The desired pH of the fixing compositions useful in this invention is 8 or less, and can be achieved and maintained using any useful combination of acids and bases, as well as various buffers.

Other details of fixing compositions not explicitly described herein are considered well known in the art, and are described for example, in *Research Disclosure* publication 38957 (noted below), and publications noted therein in paragraph XX(B), U.S. Pat. No. 5,424,176 (Schmittou et al), U.S. Pat. Nos. 4,839,262, 4,921,779, 5,037,725, 5,523,195, 5,552,264, all incorporated herein by reference for their teaching of fixing compositions.

During fixing, or bleach/fixing the composition in the processor may accumulate dissolved silver salts, and other substances that are extracted from the processed photographic element. Such materials, and particularly the silver salts, can be removed using known means, such as ion exchange, electroysis, electrodialysis and precipitation.

The method of the invention is utilized with developed color silver halide negative elements. The photographic elements to be developed can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers.

The photographic elements are preferably exposed to actinic radiation, typically in the visible region of the spectrum, to form a latent image, and then processed to form a visible dye image. Development is typically followed by the conventional steps of bleaching, fixing, or bleach/fixing, to remove silver or silver halide, washing, and drying.

Photographic color developers reduce silver halide to silver and to produce dye images in exposed areas of the material. Color developer compositions typically include one or more color developing agents and various other conventional addenda including preservatives or antioxidants (including sulfites, and hydroxylamine and its derivatives), sulfites, metal ion sequestering agents, corrosion inhibitors and buffers. These materials can be present in conventional amounts. For example, the color developing agent is generally present in an amount of at least 0.001 mol/l (preferably at least 0.01 mol/l), and an antioxidant or preservative for the color developing agent is generally present in an amount of at least 0.0001 mol/l (preferably at least 0.001 mol/l). The pH of the composition is generally from about 9 to about 13, and preferably from about 11.5 to about 12.5.

Exemplary color developing compositions and components are described for example, in EP-A-0 530 921 (Buongiome et al), U.S. Pat. No. 5,037,725 (Cullinan et al), U.S. Pat. No. 5,552,264 (Cullinan et al), U.S. Pat. No. 5,508,155 (Marrese et al), U.S. Pat. No. 4,892,804 (Vincent et al), U.S. Pat. No. 4,482,626 (Twist et al), U.S. Pat. No. 4,414,307 (Kapecki et al), in U.S. Pat. No. 4,876,174 (Ishikawa et al), U.S. Pat. No. 5,354,646 (Kobayashi et al) and U.S. Pat. No. 4,264,716 (Vincent et al), all incorporated herein for their teaching about color developing compositions.

Useful preservatives in the color developing compositions include sulfites (such as sodium sulfite, potassium sulfite, sodium bisulfite and potassium metabisulfite), hydroxylamine and its derivatives, especially those derivatives having substituted or unsubstituted alkyl or aryl groups, hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. More particularly useful hydroxylamine derivatives include substituted and unsubstituted monoalkyl- and dialkylhydroxylamines (especially those substituted with sulfo, carboxy, phospho, hydroxy, carbonamido, sulfonamido or other solubilizing groups). Mixtures of compounds from the same or different classes of antioxidants can also be used if desired.

Examples of useful antioxidants are described for example, in U.S. Pat. No. 4,892,804 (noted above), U.S. Pat. No. 4,876,174 (noted above), U.S. Pat. No. 5,354,646 (noted above), U.S. Pat. No. 5,660,974 (Marrese et al), and U.S. Pat. No. 5,646,327 (Bums et al), the disclosures of which are all incorporated herein by reference for description of useful antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

Particularly useful color developing agents include aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. A most preferred color developing agent is KODAK Color Developing Agent CD-3 for the processing of color reversal materials.

The method of this invention is used to bleach/fix color negative silver halide photographic materials comprising a silver bromoiodide emulsion with an average iodide content of grater than 1 mol % iodide, and more preferably greater than 2 mol % iodide. The color negative film element comprises a support and one or more silver halide emulsion layers (or color records) containing an imagewise distribution of developable silver halide emulsion grains, and has one or more color forming couplers associated therewith. A wide variety of types of photographic films containing various types of emulsions can be processed using the present invention, the types of elements being well known in the art. Representative color negative films that can be processed using the present invention include, but are not limited to, KODAK ROYAL GOLD® films, KODAK GOLD® PLUS 100 film, KODAK GOLD® SUPER 200 film, KODAK PRO GOLD™ film, KODAK GOLD ULTRA 400 film, FUJI SUPER G Plus films, FUJI SMARTFILM™ products, KONICA VX films, KONICA SRG3200 film, 3M SCOTCH® ATG films, AGFA HDC and XRS films films, KODAK FUNTIME™ film, KODAK EKTAPRESS PLUS™ films, EASTMAN EXR™ films, KODAK ADVANTIX™ films, KODAK MAX™ films, and FUJICOLOR NEXIA™ film.

Generally, the iodide content of the silver bromoiodide emulsions is less than about 40 mol %, preferably from about 1.0 to about 10 mol %, and more preferably, from about 2.0 to about 6 mol %. The emulsions can be of any crystal morphology (such as cubic, octahedral, cubooctahedral or tabular as are known in the art), or irregular morphology (such as multiple twinning or rounded). Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Oln et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

Such color silver bromoiodide elements generally have a camera speed defined as an ISO speed of at least 25, preferably an ISO speed of at least 50, and more preferably an ISO speed of at least 100. The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27–1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

The photographic elements processed in the practice of this invention can be single or multilayer color elements. Preferably, the elements have at least two separate light sensitive emulsion layers, and each layer contains a silver bromoiodide emulsion as defined above. Preferably the elements are multilayer color elements typically containing dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

The photographic element may also comprise a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the bromoiodide elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, and *Research Disclosure,* September 1997, Item 40145, both published by Kenneth Mason Publications, Ltd., Dudley Annex, 12a North Street, Emsworth, Hampshire PO10 7DQ, ENGLAND, the disclosures of which are incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |

-continued

| Reference | Section | Subject Matter |
|---|---|---|
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements may be used in association with materials that accelerate or otherwise modify the processing steps e.g. of bleaching or fixing to improve the quality of the image, although this is not necessary with the current invention. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The photographic elements may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The photographic elements may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384, 657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles.

The silver bromoiodide elements of the invention are generally sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support.

The invention will be illustrated by the following examples that are not meant to limit the scope.

EXAMPLES

Example 1

A bleach/fix solution was made by combining a bleaching solution component consisting of a Fe(III)MIDA$_2$ complex salt made from a solution of $Fe(NO_3)_3$ and a solution of $K_2$MIDA with a fixing solution component consisting of a solution of ammonium thiosulfate and ammonium sulfite. The two solution components were combined just before use and the pH adjusted to pH 7.0. The final solution components and their concentration in the combined bleach/fix solution are given in Table I. The solutions were heated to 45 C. and used to simultaneously bleach and fix silver from two color negative films. The films had been flash-exposed to light and developed for 3 minutes and 15 seconds in a standard Process C-41 developer formula, stopped for 60 second in 0.02N sulfuric acid bath then washed for three minutes in water and air-dried at room temperature. Samples of the films were processed in the bleach/fix solution in a hand process by scoring strips at 1 cm intervals (steps), so that the strips could be lowered into the unstirred bleach-fix solution at 10 second intervals per step. The total process time for the first step immersed was 100 seconds. One step was kept at the zero time (no bleach-fixing) point. The film strip was washed in running water for five minutes then air dried. IR transmission density for each step was plotted as a function of SQRT(total processing time) for that step. The clear time was obtained by extrapolating a least-squares straight line through the steepest part of the IR density vs. SQRT(time) curve to a time representing the final IR density at long time. This final density was obtained by bleaching a sample of each film for ten minutes in the solution to completely remove all silver. The clear times are shown in Table II, for the bleach-fix solution shown in Table I with and without the presence of the bleach accelerator compounds indicated in Table II. As the results show, this bleach-fix is able to rapidly clear silver from these high-speed color negative films in 100 second or less.

TABLE I

FeMIDA Bleach-Fix Formula

| Component | Conc.(mol/L) |
|---|---|
| Fe(NO3)3 | 0.24 |
| $K_2$MIDA | 0.60 |
| $(NH_4)_2SO_3$ | 0.08 |
| $(NH_4)_2S_2O_3$ | 0.90 |
| pH | 7.0 |
| Accelerator | (see Table II) |

TABLE II

Measured Clear Time(s) for FeMIDA Bleach-Fix (45 C.)

| | | Accelerator | |
|---|---|---|---|
| Film | None | 1.0 g/L MT* | 0.33 g/L5-ATT** |
| A | 100.8 | 99.2 | 98.9 |
| B | 86.3 | 83.4 | 77.1 |

Film A is KODAK MAX ™ 400 film
Film B is an experimental 400 speed film
*MT is 3-mercapto-1,2,4-triazole
**5-ATT is 5-amino-1,3,4-thiadiazole-2-thiol

Example 2

A bleach/fix solution of composition similar to that in Table I was prepared and mixed together. The pH was lowered from pH 7.0 to either pH 6.5 or to pH 6.0 with sulfuric acid after mixing the components, and two films were processed in the solution after raising the temperature to 45C. for silver removal. Before processing, the films were exposed, developed, stopped, washed and scribed into sections as described in Example 1. The clear times were determined as before with either no accelerator present or with 1 g/L MT also dissolved in the solution. The results, presented in Table III, show that this bleach-fix formula can easily remove silver from color negative films of differing light sensitivity, especially in the presence of the accelerator at these lower pH values.

TABLE III

| Clear Time(s) for FeMIDA Mixed Bleach-fix at 45 C. | | | |
|---|---|---|---|
| pH | MT (g/L | Film A Clear Time | Film B Clear Time |
| 6.5 | 0 | 81.0 | 75.4 |
| 6.5 | 1 | 60.7 | 59.9 |
| 6.0 | 0 | 108.0 | 92.0 |
| 6.0 | 1 | 78.0 | 79.5 |

Film A Experimental 400-speed film
Film B Experimental 200-speed film

Example 3

A bleach-fix solution was prepared using FePDTA complex salt as the active oxidizing agent. The bleach/fix composition was prepared according to the concentrations in Table IV by first adding a ferric nitrate solution to dry PDTA acid solid and dissolving the mixture with slow addition of concentrated ammonium hydroxide solution to a pH of 4.5. The fixing agents were added to this mixture using a concentrated solution of ammonium thiosulfate and ammonium sulfite. The pH was adjusted to the final value shown in Table V at room temperature with ammonium hydroxide. The solutions were heated to the temperature indicated in Table V and bleach/fixing was carried out on two pre-exposed and developed film strips as described in Example 1. The clear times are given in Table V at two pH values and two temperatures for each film.

TABLE IV

| FePDTA Bleach-Fix Formula (No accelerator) | |
|---|---|
| 0.25 M | Ferric nitrate |
| 0.275 M | Propylenediaminetetraacetic acid |
| 1.0 M | Ammonium thiosulfate |
| 0.09 M | Ammonium sulfite |

TABLE V

| Bleach-Fixing Clear Time(s) with FePDTA | | | | |
|---|---|---|---|---|
| | KODAK ADVANTIX ™ 400 | | KODAK MAX ™ 800 | |
| pH | 45 C. | 55 C. | 45 C. | 55 C. |
| 5.2 | 37.5 | 30.5 | 38.0 | 37.3 |
| 6.4 | 41.5 | 31.5 | 43.0 | 34.2 |

The powerful oxidizing complex, FePDTA, clears the silver from these two films in less than 45s at both temperatures, although higher temperature produces shorter clear times in all examples.

The invention has been described in detail with particular reference to certain preferred embodiments thereof, but it will be understood that variations and modifications can be effected within the spirit and scope of the invention.

What is claimed is:

1. A method of bleaching and fixing a developed silver halide color negative element comprising mixing a bleaching solution containing an iron complex-oxidizing agent having a redox potential greater than +150 mV vs Normal Hydrogen Electrode with a fixing solution containing a silver ion solubilizing agent to form a bleach/fixing solution;

within 1 minute of or simultaneously with said mixing, bleach/fixing the silver halide element by contacting it with the bleach/fixing solution for 20 to 120 seconds; and discarding the bleach/fixing solution after one use;

wherein the bleach/fixing step is performed at a temperature of 45° C. or greater; and wherein the silver halide color negative element comprises a silver bromoiodide emulsion with an average iodide content of more than 1 mol % iodide.

2. The method of claim 1 wherein the silver halide element is contacted with the bleach/fixing solution within 10 seconds of mixing the bleaching solution with the fixing solution.

3. The method of claim 1 wherein the silver halide element is contacted with the bleach/fixing solution simultaneously with the mixing of the bleaching solution with the fixing solution.

4. The method of claim 1 wherein the silver ion solubilizing agent is thiosulfate.

5. The method of claim 1 wherein the iron complex is 1,3-propylenediaminetetraacetic acid.

6. The method of claim 1 wherein the silver halide color negative element comprises a silver bromoiodide emulsion with an average iodide content of more than 2 mol % iodide.

* * * * *